US006746235B1

(12) United States Patent
Aszenbrenner et al.

(10) Patent No.: US 6,746,235 B1
(45) Date of Patent: Jun. 8, 2004

(54) LIQUID FUEL BURNER

(76) Inventors: Urszula Aszenbrenner, 30 Carawatha Road, Doncaster, VIC 3109 (AU); Paul Aszenbrenner, 30 Carawatha Road, Doncaster, VIC 3108 (AU)

( * ) Notice: Subject to any disclaimer, the term of this patent is extended or adjusted under 35 U.S.C. 154(b) by 35 days.

(21) Appl. No.: 10/129,093

(22) PCT Filed: Nov. 10, 2000

(86) PCT No.: PCT/AU00/01386

§ 371 (c)(1),
(2), (4) Date: May 13, 2002

(87) PCT Pub. No.: WO01/36874

PCT Pub. Date: May 25, 2001

(30) Foreign Application Priority Data

Nov. 12, 1999 (AU) ..... PQ4009

(51) Int. Cl.[7] ..... F23D 3/24
(52) U.S. Cl. ..... 431/320; 431/125
(58) Field of Search ..... 431/320, 125, 431/298; 362/392

(56) References Cited

U.S. PATENT DOCUMENTS 266,510 A * 10/1882 Peigniet ..... 431/64
766,449 A * 8/1904 King ..... 137/209
4,608,011 A * 8/1986 Comstock ..... 431/324
4,835,663 A * 5/1989 Abbott et al. ..... 362/159
5,772,425 A 6/1998 Henderson

FOREIGN PATENT DOCUMENTS

| | | |
|---|---|---|
| AU | 6551586 | 5/1988 |
| WO | 87/03064 | 5/1987 |

* cited by examiner

*Primary Examiner*—Alfred Basichas
(74) *Attorney, Agent, or Firm*—Dennison, Schultz, Dougherty & MacDonald

(57) ABSTRACT

A liquid fuel burning device includes a first fuel reservoir adapted for holding a supply of fuel, a wick system adapted to cooperate with the first reservoir to draw fuel therefrom for combustion, a second fuel reservoir and a fuel feed tube communicating between the first fuel reservoir and the second fuel reservoir. The first reservoir can be closed to form a substantially air tight seal such that as fuel is consumed from the first reservoir, a partial vacuum is created within the first reservoir which automatically draws further fuel through the feed tube from the second fuel reservoir, thereby maintaining a constant fuel supply in the first reservoir.

13 Claims, 4 Drawing Sheets

LIQUID FUEL BURNER

FIELD OF THE INVENTION

This invention relates to wick operated liquid fuel burning devices and in particular to an improved liquid fuel regulator and an improved wicking device.

BACKGROUND TO THE INVENTION

Wick operated liquid or solid fuel burning devices have been used for centuries as a means of providing controlled burning of such fuel to give light or heat.

Candles and oil burning lamps are two familiar examples of such devices. Candles have an elongate textile wick extending through a solid wax shaft where the burning of the wick heats and melts the surrounding wax which supplies the combustible fuel to keep the wick alight.

Oil burning lamps are more complex devices where a wick is suspended in a reservoir of combustible fuel and the capillary action of the wick draws liquid fuel up the wick to supply the combustible fuel to the burning area of the wick.

The quality and quantity of flame achieved by wick operated burning devices is governed by a number of factors including the type of combustible fuel used, the capillary action of the wick which controls the quantity of fuel reaching the burning surface and the amount of wick exposed for burning which affects the quantity of oxygen available to support combustion.

The expected performance of wick operated burning devices varies with the nature of the device but generally limitations in performance are attributable to one or more of the above factors. For example, in conventional burners the height of the wick determines the size of the flame and the rate of fuel use. Therefore the burn time available is dependent on the height of the wick above the combustible fuel holding receptacle and the capacity of the reservoir holding the combustible fuel. However, it has been determined that for normal wicks, the practical maximum depth of combustible fuel that can be accessed is approximately 5 inches or 125 millimeters. This limitation is due to capillary flow limitations of the wick which limits the height fuel can be drawn up a wick For large diameter burners, such as 60 millimeters or larger, the liquid volume can be greater than 200 milliliters and provide a burn time of twenty hours or more providing the vertical height of the burner does not require a wick of more than 125 mm in length. However, such burners look bully and cumbersome and do not always provide an appropriate aesthetic appearance.

For example, burners may be used to imitate a candle. Candles have been used as a decorative and practical lighting means for many centuries. However, the wax residue and the deformation of shape when wax candles used do not contribute to their decorative features. As an alternative to wax candles it has been suggested to use a fuel-burning lamp emulating a candle shaped lamp. Such a fuel-burning lamp could comprise a reservoir holding combustible fuel, upon which tubular members extend in order to provide a candle shaped burner. A wick extends from an upper external part to the internal bottom of the reservoir base. The technology used to provide and operate such candle imitating lamps has, to date, simply followed the basic principles of conventional burner design. However, as previously described, such design has limitations, particularly for wick length such that elongate candle shaped lamps often exceed the maximum practical wick length of 125 mm. A further problem involves the burn time of such lamps. Lamps capable of long burns tend to be squat and are shaped differently to a slender and elegant candle shape.

However, when burning lamps are constructed in the shape of elongate candles their size only provides a burn time of about 3 to 4 hours. Many functions such as wedding receptions and the like may extend for a period of some 6 to 8 hours. Therefore these known liquid burners must be refueled and are often considered not appropriate and not used for such events.

Various attempts to address this problem have been considered. In one proposed solution a wick extends into a fuel reservoir having a particular capacity that is filled with combustible liquid and when that combustible liquid is finished an electric pump system pumps further fluid to refill the reservoir. In this way, an extended time period of candle burning can be achieved. However, such an apparatus requires a separate power supply with a control network to pulse the electricity when the reservoir needs replenishing.

Another significant problem with known oil lamp wick systems is the variation of the size of the flame dependent on the depth of oil in the reservoir. As can be determined by the maximum practical depth of the reservoir being 5 inches or 125 millimeters there is less capillary flow when the reservoir is nearly empty and the wick must draw the oil from near the bottom of the wick over a small surface area to when the reservoir is full and the wick is drawing oil from near the top of the reservoir over the whole length of the wick The size of the flame will also be dependent on wick diameter, wick protrusion, wick material, wick structure and the like with a combination of the above determining wick capillary action. The known oil burners can be set up to provide a reasonably pleasing effect. However, there is an inherent variation of wick capillary flow which depends on the distance that the oil must flow and the amount of wick exposed to the oil/fuel. In particular, a full reservoir provides the entire wick length and large surface area thereof with a high capillary drawing of fuel which gives rise to a rich fuel mixture. As the fuel level decreases in the reservoir the amount of fuel drawn by the wick decreases as less wick surface area is exposed to the fuel, and the fuel/oxygen ratio optimises. However, as the fuel level continues to drop, the wick surface area exposed to fuel also drops giving rise to a lean mixture. Accordingly, in most liquid fuel burners the fuel mixture supplied to the wick over the time period the fuel reserves are consumed is in a state of continuous flux leading to a constantly fluxing flame.

Furthermore, the wicks in such burners suffer premature deterioration due to the non-optimal burning.

All the above problems result in practical and aesthetic limitations to the use and potential application of liquid fuel burning devices whether used as lighting lamps or heating lamps.

In the case of lighting application where burners emulate wax candles, the limitations are particularly acute as any uneven burning over the burning range of lamp can be quite undesirable and the desirable shape of the lamp (long and thin) provides a very limited available fuel supply to such shaped lamps.

One way of overcoming such limitations is to start with a larger than required aesthetic size. However, a larger size of burner will still suffer from uneven burning albeit over a longer length of time. Moreover, such articles, if used on a number of tables at a restaurant over many nights, will substantially increase costs and render such a system unacceptable in many commercial enterprises. The currently available oil lamps do not satisfactorily address this problem or provide any viable solutions.

In the case of heating lamps the uneven flame is undesirable and the limited burn time is also a problem. In addition such lamps due to their compact heat retaining design may lead to undesirable heating of the fuel reservoir as the exposed wick is generally positioned in close proximity to the fuel reservoir.

It is an object of this invention to provide an improved wick operated liquid fuel burning device and an improved liquid fuel regulator.

SUMMARY OF THE INVENTION

Accordingly in one aspect the invention provides an improved liquid fuel burning device comprising a first reservoir adapted for holding a supply of said liquid fuel, a wick system adapted to co-operate with said first reservoir to draw fuel therefrom for combustion wherein said first reservoir has a fuel feed tube communicating between the interior and exterior of said first reservoir and wherein said first reservoir can be closed to form a substantially air-tight seal such that as fuel is consumed from said first reservoir a partial vacuum is created within said first reservoir which automatically draws further fuel up said feed tube from a second fuel reservoir and a constant fuel supply is maintained in said first reservoir.

The first reservoir may take the form of a small pod having a sealed bottom and an open top.

The wick system may comprise a wick tube which traverses a cap. The wick tube will be fitted with a replaceable wick adapted to snugly fit said wick tube and the cap may be provided with a seal such that the cap can cooperate with the open top of the pod to maintain a substantially air tight seal with the pod.

Alternatively the wick system can be supplied complete as a disposable unit.

The feed tube may have a first aperture and a second aperture wherein the first aperture is positioned within said pod toward the top thereof and the second aperture is positioned outside said pod.

The second fuel reservoir may take the form of an elongate tube and will most preferably have a shape similar to an elongate wax candle.

In another embodiment the invention provides a lighting device comprising one or a plurality of the aforesaid burning devices associated with one or more second fuel reservoirs.

In another embodiment the invention provides a heating device comprising one or a plurality of the aforesaid burning devices associated with one or more second fuel reservoirs.

BRIEF DESCRIPTION OF THE DRAWINGS

Some particularly preferred embodiments will now be described with reference to FIGS. 1 to 8.

DETAILED DESCRIPTION OF THE INVENTION

Figure 1:
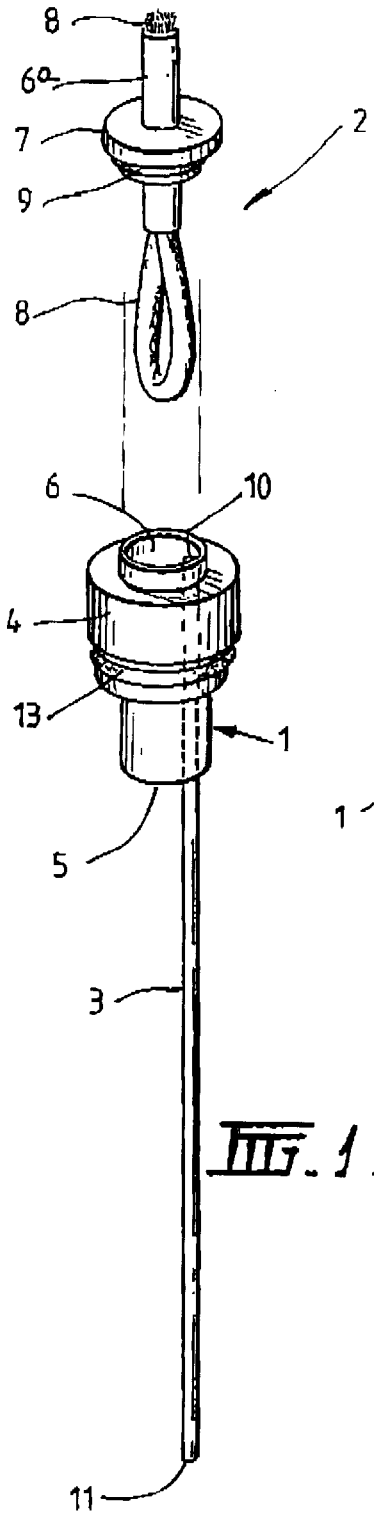
FIG. 1 shows an exploded perspective view of one embodiment of the invention.
Figure 2:
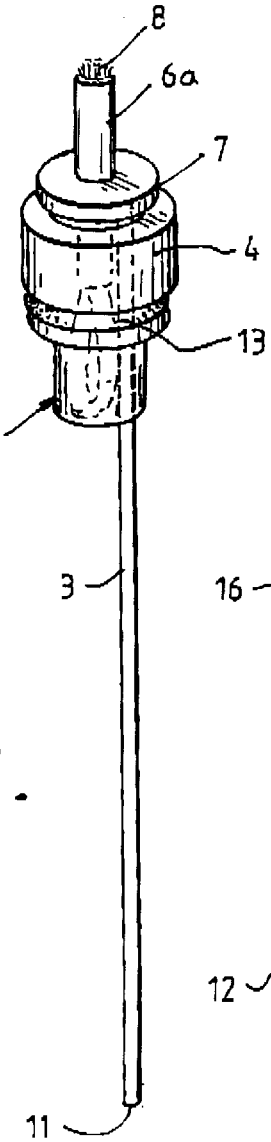
FIG. 2 shows an assembled view of the embodiment of FIG. 1.

Referring firstly to FIGS. 1 and 2 a particularly preferred embodiment of the invention is shown where the liquid fuel burning device of the invention can be seen to comprise a first reservoir 1 which takes the form of a small cylindrical pod 4 having an open top 6 and a sealed bottom 5. The first reservoir is adapted to hold a limited quantity of combustible fuel for feeding the wick system 2. The wick system is made up of a cap 7 having a wick tube 6 passing through. The wick tube is provided with a small length of wick 8 which is dimensioned to snugly fit Within the wick tube so as to establish a substantially airtight seal. The lower part of the cap 7 is provided with a seal 9 such that when the wick system 2 is fitted to the top of the pod 4 a substantially airtight seal is effected with respect to the first reservoir 1. The wick system can be produced with a replaceable wick or as a disposable unit which can be replaced as needed. The pod 4 is further provided with a feed tube 3 which provides a communication means between the inside and outside of first reservoir. The feed tube 3 can take any form and can be of virtually any shape, length or configuration. The feed tube is provided with a first aperture 10 occurring within the confines of the first reservoir 1 and most preferably being positioned toward the open top 6. The second aperture 11 is provided at the exterior end of the feed tube such that the first and second apertures provide a direct line of communication between the inside and outside of the first sealed reservoir.

FIG. 2 shows details of the assembled liquid fuel-burning device where the wick system 2 has been inserted into the open top 6 of the pod 4. The wick 8 can be seen in phantom to adopt a compact position within the first reservoir 1 and the wick can be optionally folded to provide optimal surface area and capillary drawing potential of the combustible fuel. The small size of the pod 4 and wick 8 provide a highly controlled and uniform environment for supplying a constant rate of fuel to the wick. As the fuel in the first reservoir 1 is consumed, a vacuum is created within the interior of the first reservoir which causes a suction to be effected along the length of the feed tube 3 which is communicated to the second aperture 11. The second aperture 11 of the feed tube is adapted for placement within a second reservoir which can be either associated with liquid fuel burning device or can be remotely positioned. The only requirement is for the maintenance of a line of communication between the feed tube and the supply of fuel from the second reservoir. The size of the first reservoir is not critical, but a small size in comparison with the main fuel supply in the second reservoir makes best use of the features and advantages of the invention. In particular a small first reservoir or pod allows a limited supply of combustible fuel to be stored near the operating flame, thereby reducing the chance of fire. In addition, the smaller pod size opens up a vast range of design possibilities which are free of the constraint of having a large fuel reservoir in close proximity to the operating flame. Furthermore, the absolute size of the first reservoir will depend on the type of application. In a miniature burner a very small pod would be used, with corresponding reduction in wick size and feed tube dimensions. In another application, a large garden lamp could be constructed using a larger pod, wick and feed tube to keep up the necessary fuel flow required by such a large unit. In all applications the relative size of pod, wick and feed tube would be determined to achieve optimal flame quality for the application in question.

Figure 3:
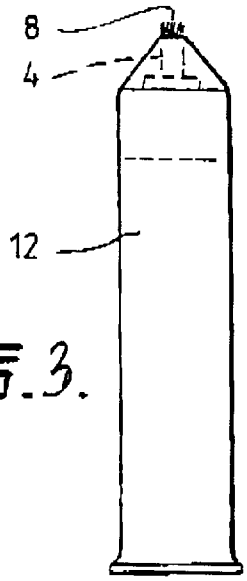
FIG. 3 shows a fully assembled view of the burning device and its second reservoir.
Figure 4:
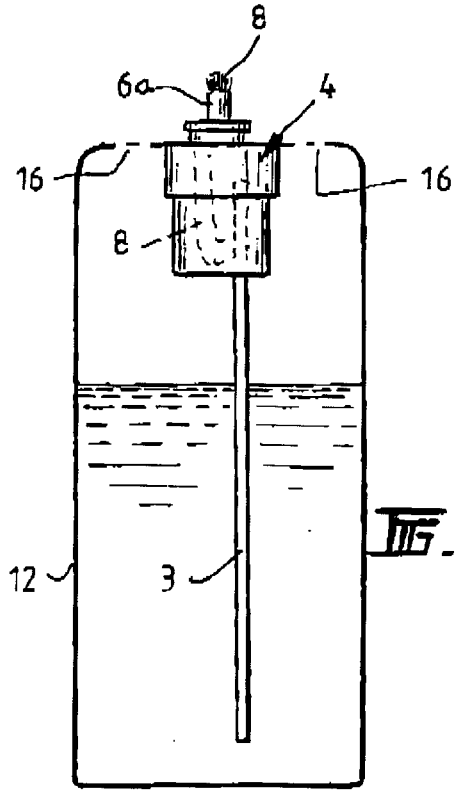
FIG. 4 shows a schematic view of a second embodiment.

Referring now to FIG. 3 one particular embodiment of the invention is shown where the burning device of the invention is used to construct a lighting device resembling a table candle. In this application the liquid fuel burning device of the invention is associated with a second reservoir 12 in the form of a slender and elongate cylindrical container mimicking the shape of a candle. The candle shaped second reservoir may have a diameter of approximately 20 mm and is able to be stood up or placed in candleholders so as to provide a suitable flamed unit substantially mimicking a dinner table candle. The length of the second reservoir can similarly mimic a candle and may be any desirable length including a length exceeding the currently available wicking potential of a standard liquid fuel-burning device which is in the order of 5 inches.

The liquid fuel burning device of the invention is able to provide for the first time a liquid fuel burning light as a close facsimile of a candle with the advantages of providing a highly extended burning time and consistent flame size and bum quality throughout the whole duration of operation. In particular with a suitable choice of fuel and wick size it is possible to achieve a burning time of at least 8 hours without the need to replenish the supply of fuel in the second reservoir.

The candle shape structure can be configured such that the pod 4 is either totally contained within or forms an integral part of the second reservoir 12 such that the mechanics involved in the device of the invention are substantially disguised with a completed device providing a very life-like resemblance to a wax candle.

In use, in the previously described embodiment the second reservoir 12 would be filled with combustible fuel and the liquid fuel burning device would be primed by filling the first reservoir 1 with fuel and inserting the pod 4 into the second reservoir 12 such that the feed tube 3 extends the substantial length of the second reservoir 12 with the second aperture 11 resting close to the bottom of the second reservoir 12. The pod 4 may be provided with an optional seal 13 (see also FIGS. 1 and 2) which may fit around the top of the second reservoir to ensure that fumes and leakage does not occur from the second reservoir. Of course, sufficient breathing capacity will be provided in the second reservoir to ensure that the vacuum occurring as fuel is used from the first reservoir is sufficient to allow fuel from the second reservoir to be drawn up the feed tube 3 to replenish and maintain a constant control fuel from the second reservoir to the first reservoir.

In a particularly preferred form the second reservoir has an internal diameter of about 19 mm and a height of about 20 cm. The pod 4 has an internal diameter of about 16 mm and a height in the order of 30 mm. The feed tube 3 has a diameter of about 1.8 mm and extends through the sealed bottom 5 of the pod down the length of the second reservoir to the bottom thereof. The wick tube 6 has a diameter of about 4 mm and the wick is a wedged double folded 3.1 mm wick 8 which allows for a measure of shrinkage after the initial burn but whilst maintaining a substantially sealed and snug fit through the wick tube. The wick tube 6 may also be provided with a device for adjusting the wick in and out of the wick tube 6 so as to allow full control of the bum. The height of the wick 8 can therefore be preset and/or adjusted and together with the size of the wick and the choice of combustible fuel the most appropriate sized flame can readily be achieved and maintained. The level of combustible fuel within the first reservoir 1 remains substantially constant throughout use due to the action of the feed tube 3 consistently and continually refilling the first reservoir 1 as the combustible liquid is consumed by the burning of the wick 8. The constant relationship between the feed tube 3 and the second reservoir 12 ensures a constant feed rate of fuel. Breather holes 16 may be provided at or near the top of the second reservoir 12 so as to ensure that atmospheric pressure is maintained within the second reservoir thereby providing the necessary differential pressures in the second reservoir and the firs reservoir as fuel is consumed.

Tables 1 to 3 show test results where the performance of the burner of the invention is clearly demonstrated where a constant flame size and quality is achieved and maintained over the complete length of the burn in contrast to currently available wick systems.

TABLE 1

| Marker level on reservoir (1 cm intervals) | Fuel used at each marker level (ml) | Cumulative fuel used (ml) | Time taken to reach each marker (min) | Cumulative burning time (min) | Flame height (cm) |
|---|---|---|---|---|---|
| 1 | 1.5 | 1.5 | 12 | 12 | 2.5 |
| 2 | 1.5 | 3.0 | 12 | 24 | 2.5 |
| 3 | 1.5 | 4.5 | 10 | 34 | 2.5 |
| 4 | 1.5 | 6.0 | 10 | 44 | 2.5 |
| 5 | 1.5 | 7.5 | 11 | 55 | 2.5 |
| 6 | 1.5 | 9.0 | 11 | 66 | 2.5 |
| 7 | 1.5 | 10.5 | 11 | 77 | 2.5 |
| 8 | 1.5 | 12.0 | 11 | 88 | 2.5 |
| 9 | 1.5 | 13.5 | 12 | 100 | 2.5 |
| 10 | 1.5 | 15.0 | 12 | 112 | 2.5 |
| 11 | 1.5 | 16.5 | 13 | 125 | 2.5 |
| 12 | 1.5 | 18.0 | 14 | 139 | 2.0 |
| 13 | 1.5 | 19.5 | 16 | 155 | 1.5 |
| 14 | 1.5 | 21.0 | 17 | 172 | 1.5 |
| 15 | 1.5 | 22.5 | 22 | 194 | 1.0 |
| 16 | 1.5 | 24.0 | 25 | 219 | 0.6 |
| 17 | 1.5 | 25.5 | 30 | 249 | 0.5 |

Table 1 shows flame height results using a standard wick holder with a 3.2 mm hole (restricting the capillary action of the wicking) $\frac{1}{8}^{th}$ inch round woven fibreglass wicking (230 mm long). Reservoir is 210 mm high and has an ID of 12.7 mm. Markers down the length of reservoir at 10 mm increments. Each segment has a volume of 1.5 ml of fuel.

TABLE 2

| Marker level on reservoir (1 cm intervals) | Fuel used at each marker level (ml) | Cumulative fuel used (ml) | Time taken to reach each marker (min) | Cumulative burning time (min) | Flame height (cm) |
|---|---|---|---|---|---|
| 1 | 1.5 | 1.5 | 6 | 6 | 5.0 |
| 2 | 1.5 | 3.0 | 8 | 14 | 5.0 |
| 3 | 1.5 | 4.5 | 7 | 21 | 5.0 |
| 4 | 1.5 | 6.0 | 8 | 29 | 5.0 |
| 5 | 1.5 | 7.5 | 7 | 36 | 5.0 |
| 6 | 1.5 | 9.0 | 8 | 44 | 5.0 |
| 7 | 1.5 | 10.5 | 9 | 53 | 4.0 |
| 8 | 1.5 | 12.0 | 9 | 62 | 3.5 |
| 9 | 1.5 | 13.5 | 10 | 72 | 3.0 |
| 10 | 1.5 | 15.0 | 13 | 85 | 2.5 |
| 11 | 1.5 | 16.5 | 14 | 99 | 2.0 |
| 12 | 1.5 | 18.0 | 16 | 115 | 1.5 |
| 13 | 1.5 | 19.5 | 18 | 133 | 1.0 |
| 14 | 1.5 | 21.0 | 22 | 155 | 0.8 |
| 15 | 1.5 | 22.5 | 26 | 181 | 0.6 |
| 16 | 1.5 | 24.0 | 29 | 210 | 0.5 |
| 17 | 1.5 | 25.5 | 31 | 241 | 0.4 |

Table 2 shows flame height results using a standard wick holder with a 4.0 mm hole (not restricting capillary action of wicking). $\frac{1}{8}^{th}$ inch round en fibreglass wicking (230 mm long). Reservoir is 210 mm high and has of 12.7 mm Markers down the length of reservoir at 10 mm increments. Each segment has a volume of 1.5 ml of fuel.

TABLE 3

| Marker level on reservoir (1 cm intervals) | Fuel used at each marker level (ml) | Cumulative fuel used (ml) | Time taken to reach each marker (min) | Cumulative burning time (min) | Flame height (cm) |
|---|---|---|---|---|---|
| 1 | | | | | 2.5 |
| 2 | | | | | |
| 3 | 0.75 | 0.75 | 6 | 6 | 2.5 |
| 4 | 1.5 | 22.5 | 14 | 20 | 2.5 |
| 5 | 1.5 | 3.75 | 14 | 34 | 2.5 |
| 6 | 1.5 | 5.25 | 13 | 47 | 2.5 |
| 7 | 1.5 | 6.75 | 13 | 60 | 2.5 |
| 8 | 1.5 | 8.25 | 13 | 73 | 2.5 |
| 9 | 1.5 | 9.75 | 12 | 85 | 2.5 |
| 10 | 1.5 | 11.25 | 13 | 98 | 2.5 |
| 11 | 1.5 | 12.75 | 12 | 110 | 2.5 |
| 12 | 1.5 | 14.25 | 13 | 123 | 2.5 |
| 13 | 1.5 | 15.75 | 13 | 136 | 2.5 |
| 14 | 1.5 | 17.25 | 13 | 149 | 2.5 |
| 15 | 1.5 | 15.75 | 13 | 162 | 2.5 |
| 16 | 1.5 | 20.25 | 13 | 175 | 2.5 |
| 17 | 1.5 | 21.75 | 13 | 188 | 2.5 |
| 18 | 1.5 | 23.25 | 13 | 201 | 2.5 |
| 19 | 1.5 | 24.75 | 13 | 214 | 2.5 |
| 20 | 1.5 | 26.25 | 13 | 227 | 2.5 |
| 21 | 1.5 | 27.75 | 13 | 240 | 2.5 |
| 22 | 3.0 | 30.75 | 24 | 264 | 2.5 |
| | Pod Fuel | | | | |
| | | | 1 | 265 | 1.5 |
| | | | 4 | 269 | 0.5 |

Table 3 shows flame height results using a primary reservoir and secondary (pod) reservoir system of the invention. Secondary reservoir, air tight, with 4.0 mm wick-holder hole, and ¼ inch fiberglass wicking (55 mm long). Reservoir is 210 mm high and has an ID of 12.7 mm. Markers down the length of reservoir at 10 mm increments. Each segment has a volume of 1.5 ml of fuel.

The particular embodiment of the invention in the form of an imitation table candle provides for the first time such a device allowing a candle like structure to be used as a liquid fuel burning light which can provide a consistent high quality flame over a substantially increased burning time thereby providing for the first time a candle like light able to be lit and used continuously for many hours without requiring maintenance or refueling.

The pod can be positioned anywhere in relation to the second reservoir with the only limitation being the need for the first reservoir in the pod being able to siphon fuel from the second reservoir. Accordingly the pod may be positioned directly above the second reservoir or to the side thereof or even immersed into the second reservoir. The pod and reservoirs may be constructed of any suitable material, including thermally insulated materials. The feeding tube may be varied in size and shape with a constant diameter along the length or tapering diameter if regulated fuel siphoning is required. The small size of the first reservoir ensures that only the fuel needed immediately is kept proximate to the flame thereby minimising waste, leakage and potential for fire due to overheating.

Figure 5:
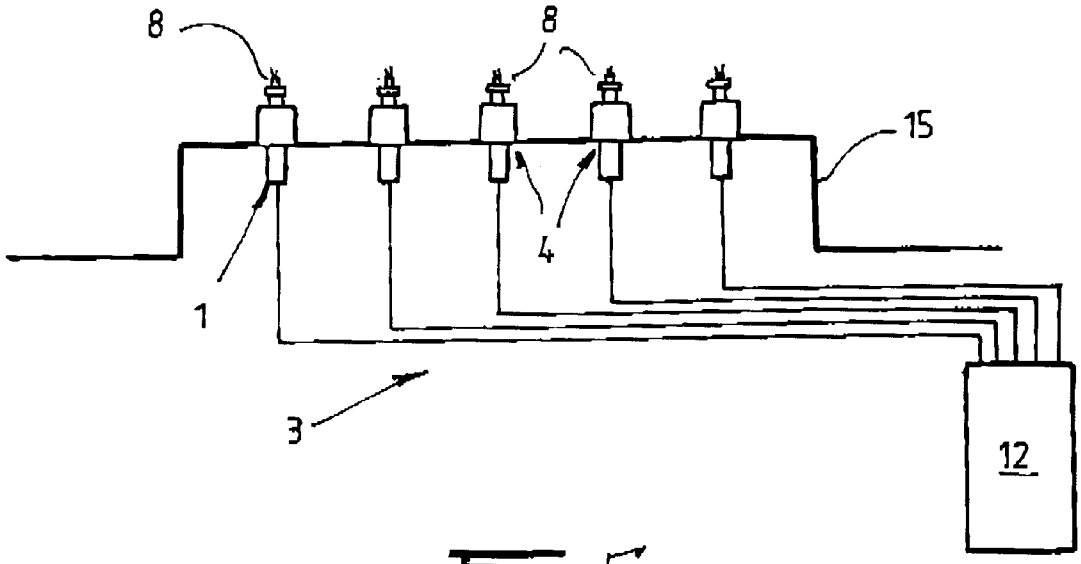
FIG. 5 shows a schematic view of a third embodiment.

Referring now to FIG. 5 a second embodiment of the invention is shown wherein the improved liquid fuel burning device of the invention is used as a heating unit and a plurality of the burning devices are assembled within a mounting or housing 15 so as to provide a flame based heating unit. The fuel burning devices of the invention are provided at regular intervals along the housing 15 with the pods 4 placed within the housing such that the wicks 8 project at regular intervals to provide the heat source. The feed tubes 3 are able to be arranged to source fuel from the second reservoir 12 which is placed remotely from the heating unit and is accessed continuously by the feeder tubes 3. Apart from the previously mentioned advantages which apply equally to the heating application as they do to the lighting application a further key advantage of this embodiment of the invention is the ability to remotely locate the main fuel source in the reservoir 12 from the source of combustion and the source of heat generation. In this manner a substantial amount of heat can be generated with the heating unit where the heat will be concentrated at the wick 8 and naturally be transmitted to the pods 4. However, this source of heat is kept remote and distant from the main fuel supply and only the intermediate and limited fuel supply in the first reservoir 1 are subjected to heat. In this manner the invention provides substantial improvements over the prior art where previous cooking devices have necessitated the close proximity of the generation of heat to the main fuel supplies causing many difficulties and potentially dangerous situations where the main fuel supply can become dangerously hot and even approach flash point.

Figure 6:
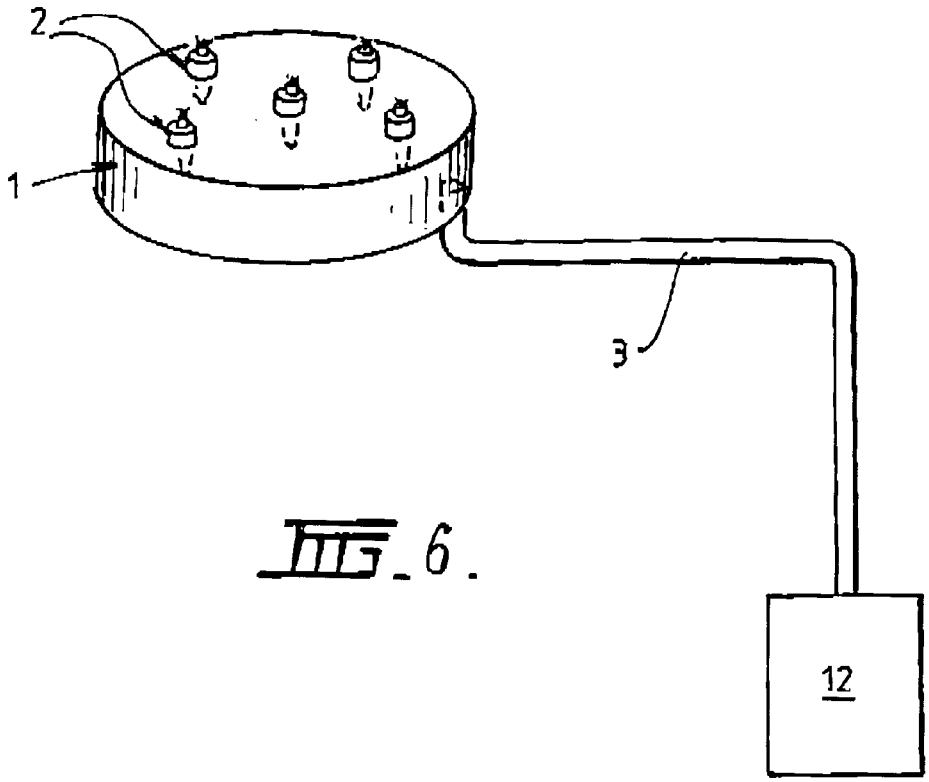
FIG. 6 shows a schematic view of a forth embodiment.

In a third embodiment of the invention a multiwicked pod is used to provide a substantial spread and delivery of heat over a large area. FIG. 6 shows such an embodiment which operates on the same principles as the single wicked units.

Figure 7:
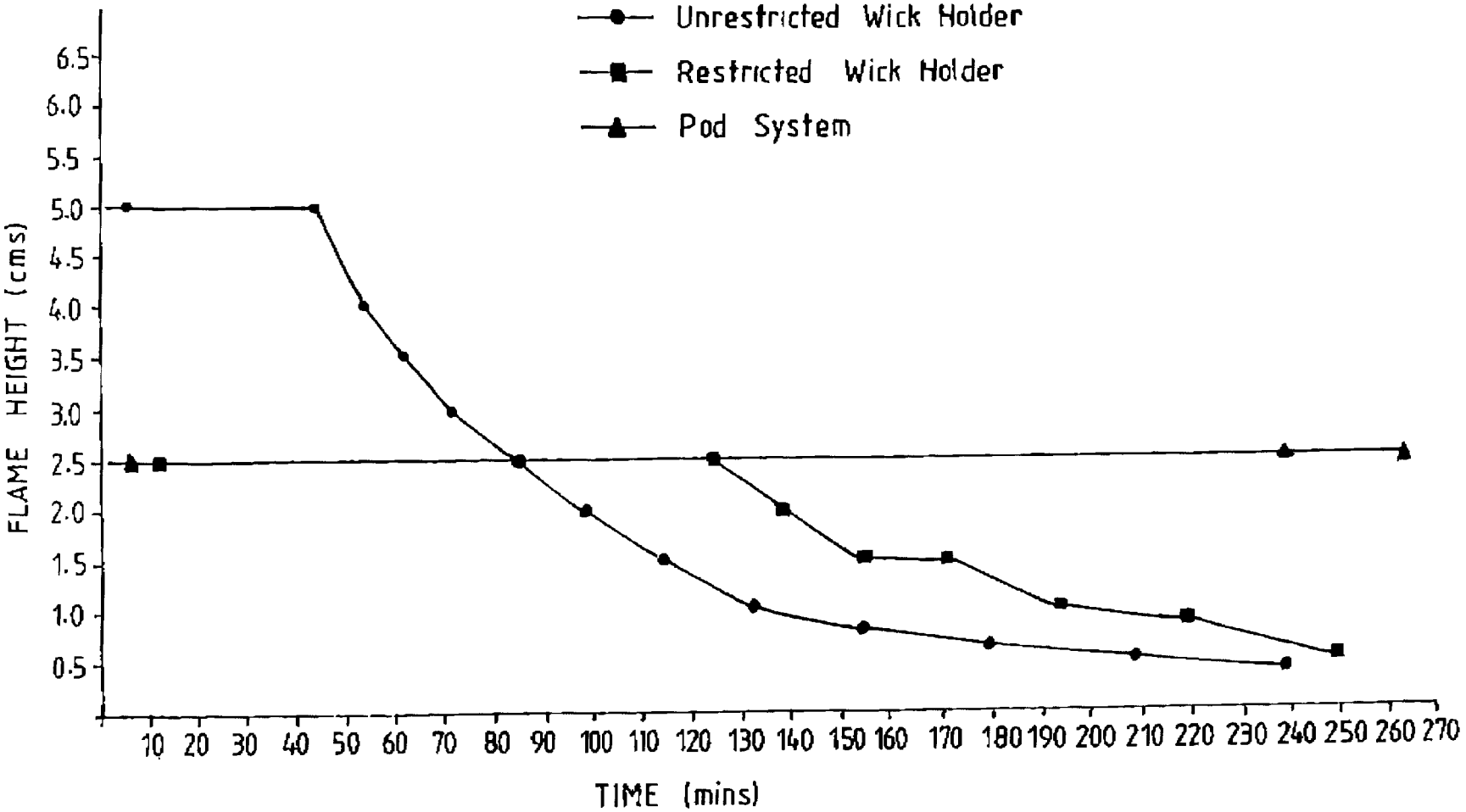
FIG. 7 shows graphical comparison of flame heights over burn time.
Figure 8:
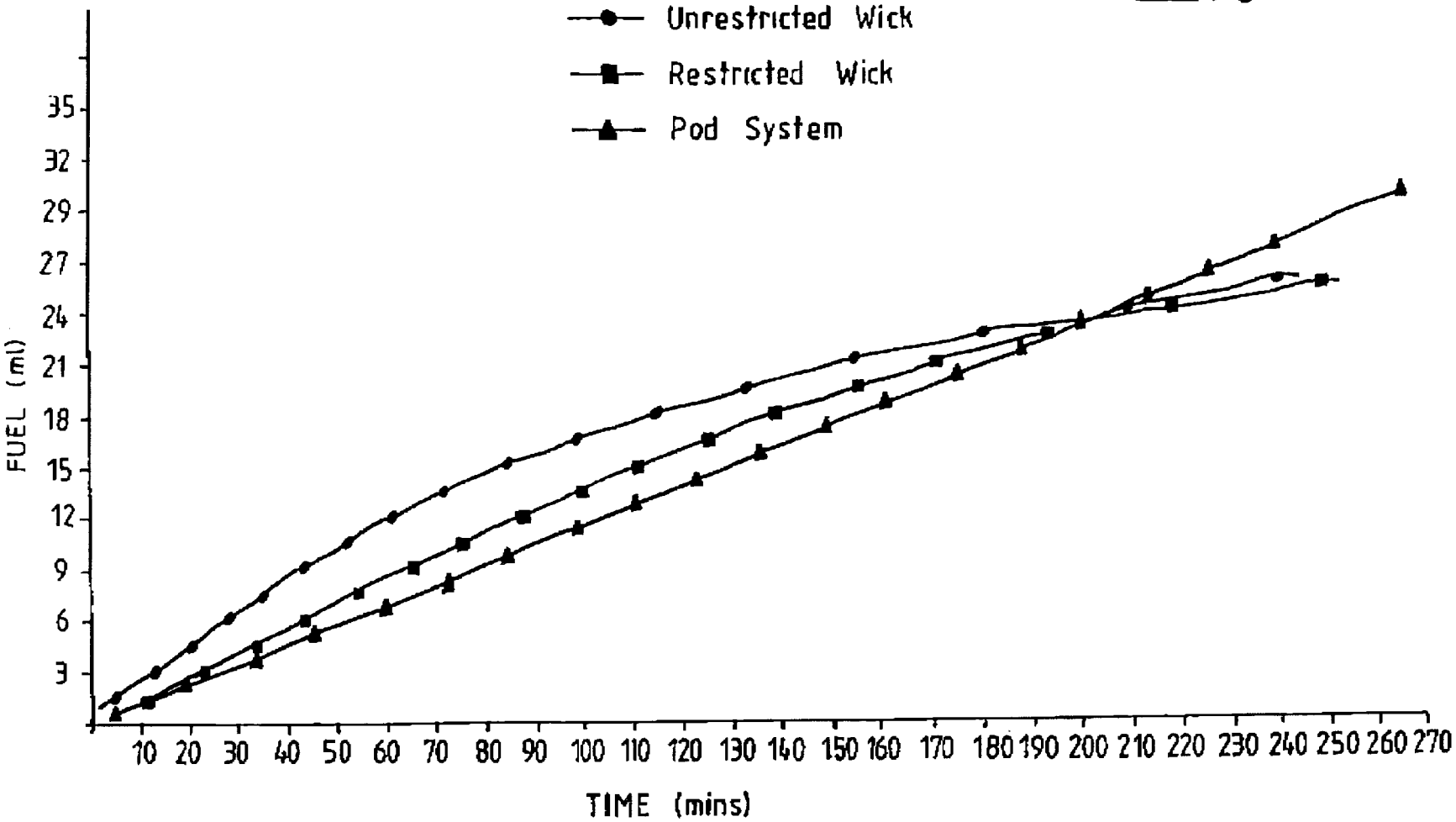
FIG. 8 shows a graph of fuel usage over time.

FIGS. 7 and 8 give comparative results of flame height and fuel usage of conventional burning units compared to the burner of the invention. The results clearly demonstrate the highly constant performance of the burner of the invention where flame height and fuel usage remain constant during the whole burn time.

The novel features of the liquid fuel burner of the invention provide an enormous range of possible options and configurations previously not available for light and heat providing fuel lamps. The ability to provide a continuous and totally controllable flame for an indefinite time period sourcing fuel from a remote reservoir, opens up applications not previously available for such burners. Not only are the applications vastly improved by the current invention, but the safety, cleanliness and general convenience of operation is also vastly improved.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

What is claimed is:

1. A liquid fuel burning device comprising:

a first reservoir adapted for holding a supply of fuel and being closable to form a substantially air-tight seal;

a wick system adapted to cooperate with said first reservoir to withdraw fuel therefrom for combustion;

a second reservoir for containing fuel, said second reservoir being in the shape of an elongate cylinder which cooperates with said first reservoir to form an integrated unit; and a feed tube communicating between the first reservoir and the second reservoir, the feed tube having an opening at or near a bottom portion of said second reservoir;

wherein withdrawal of fuel from said first reservoir for combustion creates a partial vacuum therein which automatically draws further fuel through said feed tube from said second reservoir, thereby maintaining a constant fuel supply within said first reservoir.

2. A liquid fuel burning device of claim 1, wherein said first reservoir is in the form of a pod having a sealed bottom and open top.

3. A liquid fuel burning device of claim 2, wherein said wick system includes a cap adapted to sealably fit to the open top of said pod, a wick tube traversing said cap and a wick adapted for snug fit through said wick tube.

4. A liquid fuel burning device according to claim 1, wherein said feed tube has an aperture positioned toward a top portion of said first reservoir.

5. A liquid fuel burning device according to claim 1, wherein said first reservoir has a smaller capacity than said second reservoir.

6. A liquid fuel burning device according to claim 5, wherein said first reservoir takes the form of a small pod.

7. A liquid fuel burning device according to claim 1, shaped as a wax table candle.

8. A liquid fuel burning device according to claim 1, wherein said wick tube comprises a wick adjuster for moving the wick in and out of said wick tube.

9. A liquid fuel burning device comprising:

a first reservoir adapted for holding a supply of fuel and being closable to form a substantially air-tight seal;

a wick system adapted to cooperate with said first reservoir to withdraw fuel therefrom for combustion;

a second reservoir remote from said first reservoir for containing fuel;

a feed tube communicating between the first reservoir and the second reservoir;

wherein withdrawal of fuel from said first reservoir for combustion creates a partial vacuum therein which automatically draws further fuel through said feed tube from said second reservoir, thereby maintaining a constant fuel supply within said first reservoir.

10. A liquid fuel burning device comprising:

a first reservoir adapted for holding a supply of fuel and being closable to form a substantially air-tight seal;

a plurality of wick systems, each said wick system comprising a cap adapted to sealably fit to an opening in a top portion of said pod, a wick tube traversing said cap and a wick adapted for snug fit through said wick tube, each said wick system adapted to cooperate with said first reservoir to withdraw fuel therefrom for combustion;

a second reservoir for containing fuel; and a feed tube communicating between the first reservoir and the second reservoir;

wherein withdrawal of fuel from said first reservoir for combustion creates a partial vacuum therein which automatically draws further fuel through said feed tube from said second reservoir, thereby maintaining a constant fuel supply within said first reservoir.

11. A liquid fuel burning device comprising:

a plurality of first reservoirs adapted for holding a supply of fuel and being closable to form a substantially air-tight tight seal;

a wick system associated with each of said first reservoirs adapted to cooperate with said first reservoir to withdraw fuel therefrom for combustion;

at least one second reservoir for containing fuel; and a plurality of feed tubes, each of said feed tubes communicating between one of said first reservoirs and said at least one second reservoir;

wherein withdrawal of fuel from said first reservoirs for combustion creates a partial vacuum therein which automatically draws further fuel through said feed tube from said at least one second reservoir, thereby maintaining a constant fuel supply within said first reservoirs.

12. A liquid fuel burning device according to claim 11, which a lighting device.

13. A liquid fuel burning device according to claim 11, which is a heating device.

* * * * *